United States Patent [19]

Ratelband

[11] Patent Number: 4,616,628

[45] Date of Patent: Oct. 14, 1986

[54] FIRE-GUARD

[76] Inventor: Johannes B. Ratelband, "Rijnstateflat" Utrechtsestraat 55-34, 6811 LV Arnhem, Netherlands

[21] Appl. No.: 598,713

[22] Filed: Apr. 10, 1984

[30] Foreign Application Priority Data

Apr. 14, 1983 [NL] Netherlands ..... 8301306

[51] Int. Cl.[4] ..... F24B 7/00

[52] U.S. Cl. ..... 126/121; 126/140; 16/253

[58] Field of Search ..... 126/121, 140, 202; 256/26; 16/253, 386; 285/137 R; 160/DIG. 9, 351; 165/171, 172; 138/106, 112

[56] References Cited

U.S. PATENT DOCUMENTS

| | | | |
|---|---|---|---|
| 1,261,678 | 4/1918 | Barnes et al. | 16/253 |
| 2,763,890 | 9/1956 | Cox | 16/253 |
| 4,290,409 | 9/1981 | Mayo | 126/121 |
| 4,304,216 | 12/1981 | Ratelband | 126/121 |
| 4,412,524 | 11/1983 | Ratelband | 126/121 |

FOREIGN PATENT DOCUMENTS

| | | |
|---|---|---|
| 691340 | 10/1930 | France . |
| 1344299 | 10/1963 | France . |
| 808053 | 1/1959 | United Kingdom . |
| 901860 | 7/1962 | United Kingdom . |
| 197465 | 5/1983 | United Kingdom . |

*Primary Examiner*—Randall L. Green
*Attorney, Agent, or Firm*—John P. Snyder

[57] ABSTRACT

A fire-guard is provided for heating a room by convection using the heat from a radiant heat source, such as a fire in a fireplace. The fire-guard includes a plurality of substantially vertically extending pipes. Each of the pipes has an inlet opening located adjacent to its lower end for receiving relatively cool air and an outlet opening located adjacent to its upper end for passing air heated by the fire-guard into the room. The portion of the fire-guard extending from its base to a height above the inlet openings constitutes a threshold for preventing the movement of air between adjacent pipes into the radiation heat source. The two pipes of at least one pair of adjacent pipes are hinged together in such a manner to permit pivoting by one of the two pipes about the longitudinal axis of the other of the two pipes.

14 Claims, 6 Drawing Figures

FIG. 1
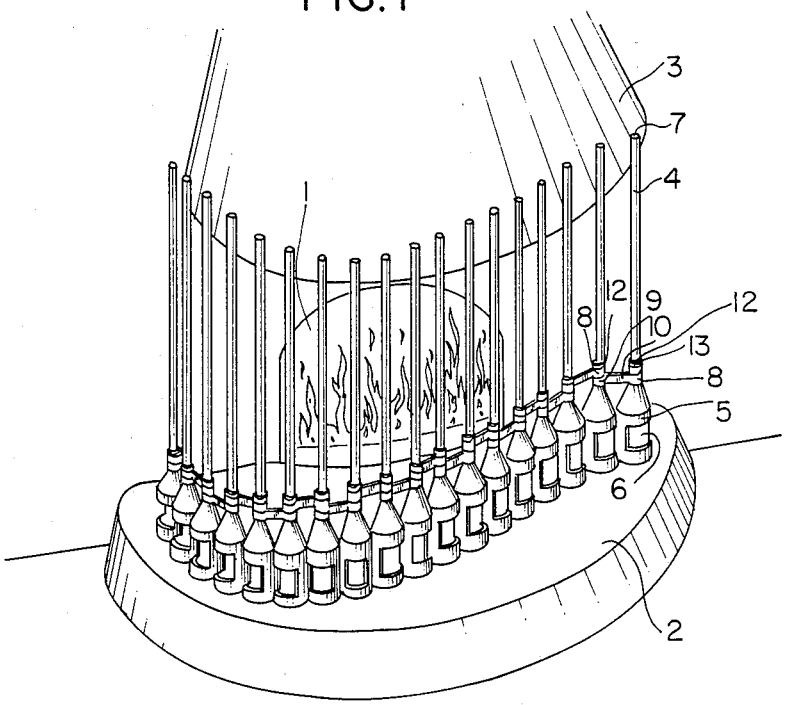
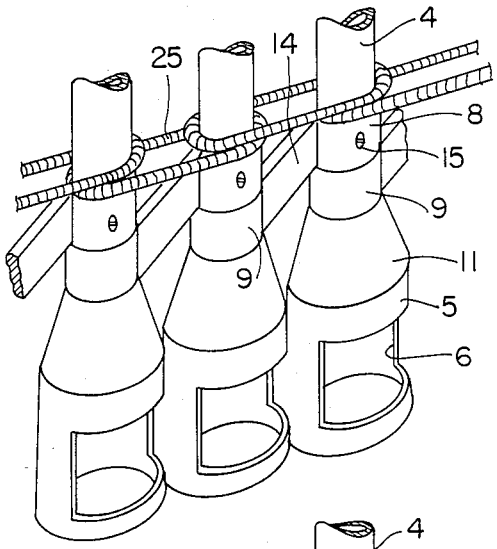
FIG. 2
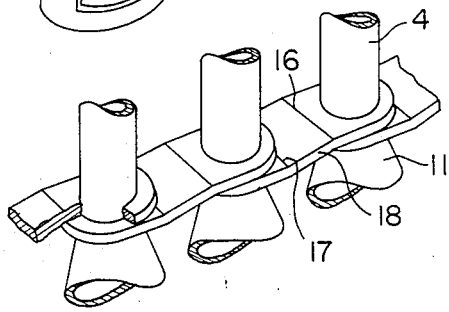
FIG. 3

FIG. 5
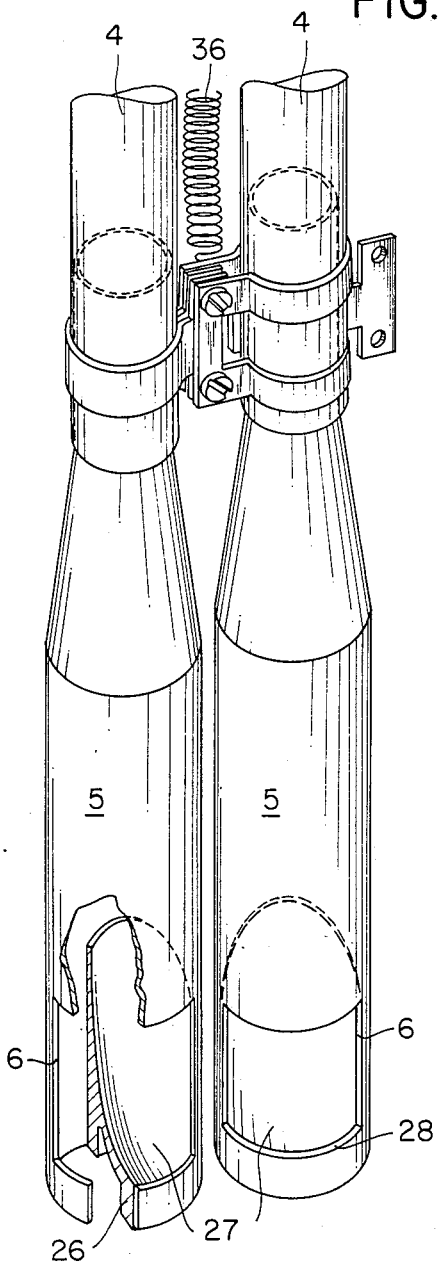
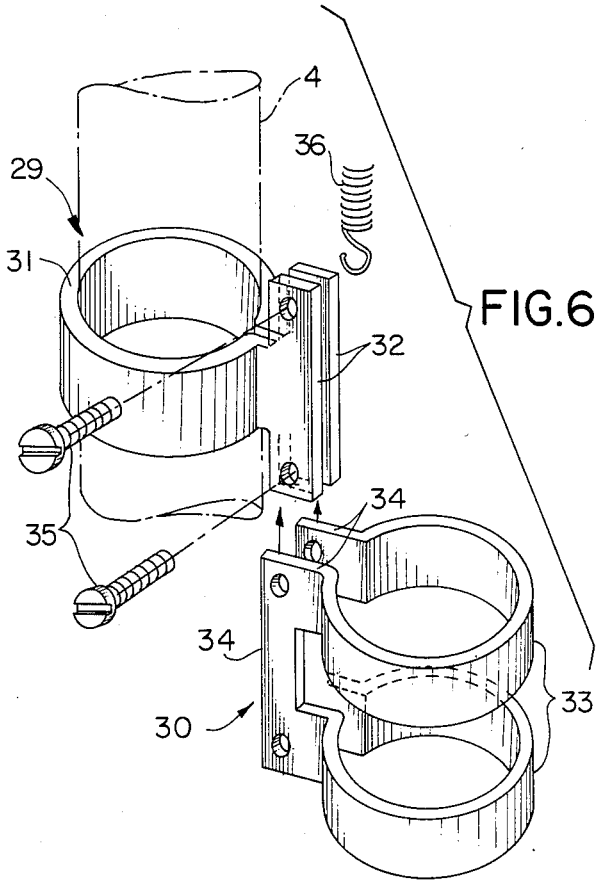
FIG. 6

FIRE-GUARD

FIELD OF THE INVENTION

The present invention relates to a device for heating a room by convection using the heat from a radiation heat source, and in particular, to a convection heating device having pipes wherein at least one of two adjacent pipes is pivotal about the longitudinal axis of the other one of the two adjacent pipes.

BACKGROUND INFORMATION

A number of devices have been devised for the purpose of heating air in a room using a source of radiation heat, e.g., a fire in a fireplace. Among such devices are fire-guards characterized by the use of a number of vertically extending, interconnectable pipes. In such fire guards, the lower portions thereof act as part of a threshhold to prevent air from bypassing the fire-guard and entering the fireplace. Previously devised fire guards were also of a kind in which pairs of adjacent pipes were hinged together so that the fire-guard pipes could be positioned to best surround the fire and therefore have maximum exposure to the fire. These fire-guards include hinges with pivoting pins placed between adjacent pipes. The pivoting action of the hinge is about the pivoting pin. However, such hinges are an expensive part of the fire-guard and are often difficult to manufacture.

The present invention is intended to reduce the cost of the fire-guard and simplify manufacture thereof. This is achieved in the present invention by a configuration in which one or more pipes are pivotable about the longitudinal axis of another pipe, rather than about a pivoting pin located between the two pipes of a pair of pipes. Also in contrast to previously designed fire-guards, the threshhold is formed in certain embodiments by using only the lower portions of pipes themselves and not pivoting pins between the pipes or other hardware, which were used in previous fire-guards to act as a barrier or threshhold to incoming air.

SUMMARY OF THE INVENTION

The fire-guard of the present invention includes a number of vertically extending pipes. Each of the pipes includes a lower portion having an inlet opening for receiving relatively cool air and an outlet opening from which the air, heated by a source of radiant energy while moving through the pipe, exits to warm the room in which the fire-guard is located. The lower portions of the pipes extend from the surface on which they are supported and, in one embodiment, are wider or have a greater diameter than upper portions of the pipes. In such an embodiment, the pipe lower portions themselves touch or nearly touch each other to form the threshhold for preventing air from bypassing the fire-guard. The air instead passes into the inlet openings to be heated in the pipes of the fire-guard.

Each pair of pipes of the fire-guard are hingingly interconnected by means which enable at least one of the two pipes of a pair of pipes to pivot about the longitudinal axis of the other of the two pipes. Consequently, one of the two hingingly interconnected pipes itself constitutes a pivoting pin.

Various embodiments of the means for causing a pipe to itself act as a pivoting pin have been developed in the present invention. In one embodiment, the interconnecting means between adjacent pipes includes a pair of rings and an intermediate member. One of the two rings surrounds a part of the upper portion of one pipe while the other of the two rings surrounds a part of the upper portion of the other adjacent pipe. The intermediate member rigidly interconnects the two rings. The pipes may be freely rotatable relative to the rings, or one of the two rings may be provided with means for locking the same against rotation relative to the pipe extending through the ring. In another embodiment, the interconnecting means includes a plate having two holes so that one of a pair of pipes is received in one of the holes while the other of the two pipes is received in the other of the two holes. Like the just described embodiment using rings, it may be desirable to prevent relative movement between the plate and one of the two pipes of the pair of pipes. This can be accomplished by means of a force or tight fit between one of the two holes and the pipe received in the hole. In still another embodiment, the interconnecting means includes an intermediate member and four rings connected thereto. Two of the rings extend laterally from one side of the intermediate member while the other two rings extend laterally from the opposite side of the intermediate member. The intermediate member acts as a portion of the threshhold and this embodiment is used when the width or diameter of each of the pipes is substantially the same throughout the longitudinal extent of the pipes. In this embodiment, a first pipe is received by two of the rings extending from one side of the intermediate member while the second of the pair of pipes is received by the two rings extending from the opposite side of the intermediate member. In still yet another embodiment, the means for permitting pivotal movement about a longitudinal axis of the pipe includes two separate clasping members or strips. One clasping member is fitted around one of the two adjacent pipes while the other of the two clasping members is positioned around the second pipe. Each clasping member includes two parallel end portions which are joined together by screws to provide the connection between the clasping members. One of the clasping members further includes a single ring while the other clasping member has at least two spaced apart coaxial rings. One of the two adjacent pipes is received by the single ring while the other of the two adjacent pipes is held by the two coaxial rings.

From the foregoing, it is seen that a number of worthwhile objectives of the present invention are achieved. A fire-guard is provided, having pivoting pipes, which is relatively simple to manufacture because the pipes themselves act like pivoting pins. Relatedly, the cost associated with the manufacture of the fire-guard is reduced because a hinge construction which uses pivoting pins is not needed. Additionally, in some embodiments, the lower portions of the pipes only, and not additional hinge structure, act as a barrier or threshhold to air such that air enters the inlet openings of the pipes and does not pass around the lower portions of the pipes.

Additional advantages of the present invention will become readily apparent from the following discussion when taken in conjunction with the accompanying drawings.

BRIEF DESCRIPTION OF THE DRAWINGS

FIG. 1 is a perspective view of the present invention positioned about a fire in a fireplace;

FIG. 2 is a perspective view of a portion of a fire-guard of the present invention showing one embodiment in which rings are positioned along the longitudinal extent of the pipes for use in permitting a pipe to act as a pivoting pin;

FIG. 3 shows a fragmentary, perspective view of a portion of another fire-guard embodiment in which pairs of adjacent pipes are connected by means of a plate having holes;

FIG. 5 shows a fragmentary, perspective view of still yet another embodiment of the fire-guard in which adjacent pipes are joined together by clasping members having parallel end portions and rings; and FIG. 6 is an enlarged exploded view of the clasping members of FIG. 5.

DETAILED DESCRIPTION OF THE PREFERRED EMBODIMENTS

Figure 4:
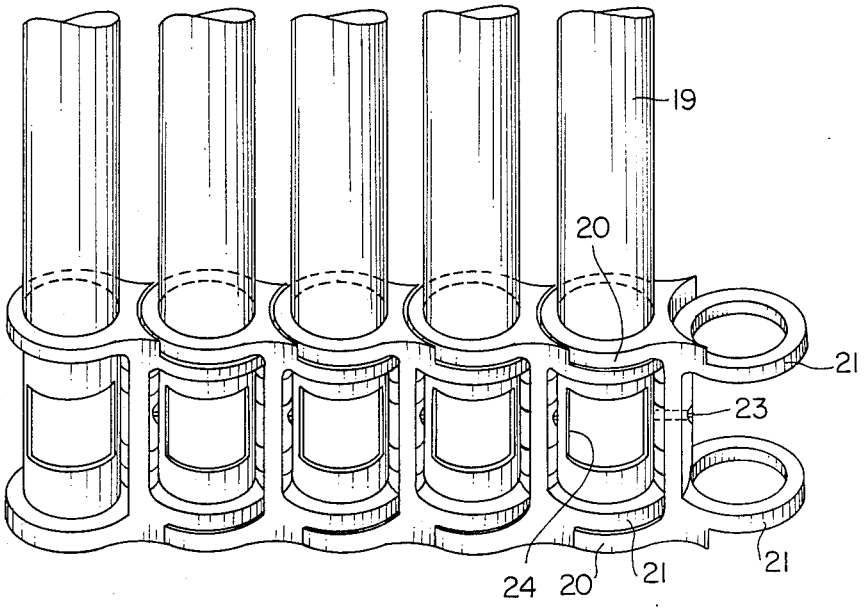
FIG. 4 shows a fragmentary, perspective view of a portion of still another fire-guard embodiment in which adjacent pipes are interconnected by an intermediate member having laterally extending rings.

In accordance with the present invention, a fire-guard is provided about a fire space 1 and supported on a fire plate 2 positioned in front of the fire space 1. A cap 3 is located above the fire plate 2.

The fire-guard includes a number of substantially vertically extending pipes, with each pipe including an upper portion 4 having a circular cross sectional area and a lower portion 5 also having a circular cross sectional area but having an outer diameter which is larger than that of the upper portion 4. The lower portion 5 of each of the pipes has near its lower end an inlet opening 6. The upper portion 4 of each of the pipes has an open upper end 7 which serves as an outlet opening. In operation, relatively cool air is received by the inlet openings 6 in the pipes and passes upwardly through the pipes. The air is heated by the fire as it passes through the pipes so that heated air escapes the open upper ends 7 of the pipes and the heated air passes into the room to warm the same.

As also can be seen in FIG. 1, the pipes are interconnected in pairs by means of an interconnecting assembly or hinged joint. The hinged joint is a one piece member and includes a ring or bushing 8 surrounding a part of the upper portion 4 of a pipe, a ring or bushing 9 surrounding a part of the upper portion 4 of an immediately adjacent pipe, and an intermediate member 10 rigidly interconnecting the two rings 8, 9. In the case of a pipe being joined to a pipe on both sides thereof, this middle pipe has a ring 8 surrounding a portion thereof and also a ring 9 surrounding another portion thereof. Each of the hinged joints comprising the rings 8, 9 and the intermediate member 10 are confined and not permitted to move in an axial direction towards the upper end 7 of the pipe by means of a ring 12 having a locking screw 13 which connects the ring 12 to the part of the pipe adjacent to the ring 8.

The hinged joints of the embodiment of FIG. 1 permit the pipes to be turned in any direction. Also, such joints enable one or more pipes to be pivoted about the longitudinal axis of another pipe thereby enabling the fire-guard pipes to be placed in a desirable position relative to the fire while simplifying the number of parts used in the hinged joint. Additionally, the lower portions 5 of the pipes are located against each other to thereby form a threshhold along the width of the fire-guard. As a result, air cannot pass between the pipes, but rather enters the inlet openings 6 of the pipes so that the air can be heated in the pipes.

It should be understood that the pipes may also be interconnected near their upper ends 7 by the same kind of elements making up the hinged joints. In such a case, the joints may then be held on the pipes using rings 12 and locking screws 13 located above and below the hinged joints.

Referring now to FIG. 2, another embodiment for hingingly interconnecting adjacent pipes is shown. In this embodiment, each of the rings 9 is located below each of the rings 8 in a longitudinal direction. This is accomplished by an intermediate member 14 which is slanted or inclined between adjacent pipes in its connection of the rings 8, 9. Also in this embodiment, each ring 8 is rigidly attached to a part of the upper pipe portion 4 which extends through the ring 8. This fixed attachment can be provided by means of a self-tapping screw 15, for example. This configuration of hinged joints prevents the pipes from being turned with their inlet openings 6 toward the fire instead of toward the room for receiving the relatively cool air. Preferably also, as seen in FIG. 2, an annularly closed helical spring 25 is provided around each of the two adjacent pipes. The helical spring 25 is provided to keep the lower portion 5 of the pairs of pipes forced one against the other in a substantially air-tight manner so that air cannot pass therebetween towards the fire space 1. It should be understood that other types of helical springs can be used to hingingly interconnect pairs of adjacent pipes, such as various shaped leaf springs.

In FIG. 3 another embodiment is shown for providing a hinged joint between two adjacent pipes. As is shown, the hinged joint includes a plate 18 having two holes with one of the holes receiving one of the pipes of a pair of pipes adjacent to the widening upper end portion 11 of the lower portion 5 of each pipe and adjacent to the upper portion 4 of each pipe. Each plate 18 is bent at 16 and 17 and in the case of more than two pipes, additional plates 18 are utilized so that plate holes are axially aligned so that pipes are received by two holes of two different plates. Preferably, one of the two adjacent pipes is force fitted into one of the holes of the plate 18 so that the plate 18 moves with that pipe, while the other hole of the plate 18 holds the second of the two pipes so that relative movement is achieved between the plate and the second of the two pipes.

The present invention relating to the pivotal movement of pipes about the longitudinal axis of another pipe is also applicable to the embodiment of FIG. 4 in which the fire-guard includes pipes 19. The pipes 19, unlike the pipes in the previously discussed embodiments, essentially have the same cross sectional area throughout their longitudinal extent. In this embodiment, the hinged joints themselves form part of the threshhold to prevent air from passing between the pipes 19. In particular, the hinged joint includes a first set of two coaxial rings 20 spaced apart by a given distance, and a second set of two coaxial rings 21 spaced apart by a distance smaller than the distance between the two coaxial rings 20. The two coaxial rings 21 are formed so that they can be coaxially positioned between the rings 20 of an adjacent hinged joint. Each hinged joint further includes a vertical intermediate member 22 which interconnects the two rings 20 and the two rings 21. Each intermediate member 22 is located between portions of two adjacent pipes 19 and occupies the space therebetween. Inlet openings 24 in the pipes 19 are formed so that the inlet openings are located between the rings 21. The rings 20, as well as the rings 21, together with the intermediate member 22 of each hinged joint, form a portion of a threshhold to incoming air so that air adjacent the supporting surface of the fire-guard passes into the inlet openings 24 for movement through the pipes 19. Pivotal movement of one or more pipes 19 about the longitudinal axis of another pipe 19 is assisted by the use of screws 23 in that each intermediate member 22 is fixedly attached by one of the screws 23 to one of the pipes 19.

Another embodiment of a fire-guard, having pipes with cross sectional areas in their lower portions 4 being different from the cross sectional areas of the upper portions 5 of the pipes, is shown in FIGS. 5 and 6. In particular, FIG. 5 shows a pair of pipes having upper portions 4 and lower portions 5. Inlet openings 6 are also formed in the lower portions 5 of the pipes, just as in the other embodiments. Each inlet opening 6 is provided with a plug 26 having an inwardly pointing upper end face 27, which is slopingly curved towards the lower edge 28 of the inlet opening 6. The sloping end face 27 of the plug 26 reduces the resistance met by the air flowing from the room into the inlet openings 6 of the fire-guard. As a result, the plug 26 facilitates the movement of the air in an upwardly direction through the pipes. It is readily appreciated that the plug 26 can also be used in conjunction with the other embodiments of the present invention.

In the embodiment of FIGS. 5 and 6 the hinged joint used to join together two adjacent pipes includes clasping members 29, 30. The clasping member 29 is used to engage an upper portion 4 of one of the pipes while the other clasping member 30 is used to engage the upper portion 4 of the second of the pair of pipes. The clasping member 29 includes an integral one piece member including a ring 31 and a pair of vertically extending parallel end portions 32. The ring 31 is joined to the parallel end portions 32 substantially along the middle of the vertical extent of the end portions 32. Holes are formed in both ends of each of the parallel end portions 32.

The clasping member 30 is also an integral one piece member including a pair of rings 33 and a pair of vertically extending parallel end portions 34. One ring 33 is connected to one end of the parallel end portions 34 while the other of the two rings 33 is connected at the opposite end of the parallel end portions 34. Both of the parallel end portions 34 include holes formed at the ends thereof. In forming the hinged joint, the ring 31 of the clasping member 29 is positioned around a part of the upper portion 4 of a pipe and the rings 33 are positioned around parts of the upper portion 4 of an adjacent pipe. The clasping members 29 and 30 are arranged such that the parallel end portions 32 are located between the parallel end portions 34. The end portions 32, 34 are positioned so that the holes formed at the respective ends of the end portions 32, 34 are aligned. To interconnect the end portions 32, 34, screws 35 are located through the aligned holes at the ends of the end portions 32, 34.

In connection with the rotation of pipes relative to the clasping members 29, 30, it is preferred that the ring 31 be of a size or dimension such that it is rigidly clamped to its pipe so that there can be no relative rotation between the ring 31 and the pipe to which it is joined. Conversely, the size or dimension of the rings 33 are selected so that relative rotation is permitted between the rings 33 and the pipe to which the rings 33 are joined. In this regard, to facilitate the relative rotation, as well as the assembly of the fire-guard, although not shown, each of the rings 33 may include a gap or space in the rings 33 at those portions of the rings 33 which are about 180° from the end portions 34.

Related to the interconnection of more than two pipes using the hinged joint of this embodiment, the distance between the two rings 33 is at least equal to the height of the ring 31 so that a ring 31 can be received between the spaced rings 33. Also shown in FIGS. 5 and 6 is a helical spring 36 having a hook which can be attached to a screw 35 at one end of the spring 36. The opposite hooked end of the spring 36 is connected to another screw 35 joined to additional clasping members 29, 30 which are connected to a part of the pipe located at the upper ends 7 thereof. Consequently, each pair of pipes has two clasping members 29, 30 located adjacent to the top part of the lower portions 5 of the pipes and two clasping members 29, 30 located adjacent to the upper ends 7 of the pair of pipes. The spring 36, which extends between the sets of clasping members 29, 30 is used to prevent sparks from the fire from passing through the spaces left between the upper portions 4 of adjacent pipes. Additionally, the use of springs 36 enables one to use the same spring regardless of the length or height of the upper portions 4 of the pipes. This feature is particularly advantageous in those cases in which the upper portions 4 of the pipes are separable from the lower portions 5 of the pipes, such as is illustrated in FIG. 5 in which the top parts of the lower portions 5 of the pipes are received into and connected to separate pipe upper portions 4.

Although each of the foregoing embodiments illustrates all pairs of pipes being hingingly interconnected so that each of the pipes can act like a pivot pin in which other of the pipes pivot thereabout, it is not necessary that such be the case. Rather, some, but not all, of the pipes may be hingingly interconnected.

In view of the foregoing description, it is readily seen that a number of advantages of the present invention are provided. In particular, a fire-guard is disclosed having pipes which can be pivoted or moved to surround a source of radiation heat. In achieving this movement, one or more vertically extending pipes are pivotal about the longitudinal axis of another pipe. This configuration does not require a separate pivoting pin. As a result, the making of the fireguard is simplified and the cost thereof reduced.

Although the present invention has been described with reference to a plurality of embodiments, it is readily appreciated that further modifications can be effected within the spirit and scope of this invention.

What is claimed is:

1. A fire-guard adapted to convert radiant energy from a fire to convection flow of heated air, comprising a plurality of upstanding pipes having substantially vertical longitudinal axes, and connecting means for interconnecting said pipes in side-by-side relation so as to be disposed in a row on a supporting surface to form a screen between a fire and the space which the fire is heating:

each of said pipes having a lower portion extending to a selected height above the supporting surface and an upper portion extending coaxially therewith to a height substantially greater than said selected height, said connecting means maintaining said pipes with their longitudinal axes in parallel, upright relation with their lower portions adjacent one another and cooperating to form an air barrier extending from said supporting surface to said selected height and an air flow-through region above said selected height through which air may flow toward the fire, said lower portions having laterally facing inlet openings directed toward said space to allow cool air to flow into the interiors of said pipes below said selected height, said upper portions having openings adjacent the upper ends thereof for discharging heated air by convection into said space; and said connecting means including hinge means connecting the pipes of at least one pair of adjacent pipes, said hinge means comprising a rigid link having its opposite end portions interconnected with said pipes such that the pipes are constrained for lateral movement with the associated ends of the link whereby the longitudinal axes of said pipes are maintained by said link at a fixed distance from one another at all times and each pipe may swing about the longitudinal axis of the opposite pipe only in an arc having a radius equal to said distance, one of said pipes also being independently rotatable about its own longitudinal axis with respect to the link whereby the other pipe may swing about the longitudinal axis of said one pipe while said one pipe remains stationary.

2. In a fire-guard as defined in claim 1 wherein said hinge means pivotally interconnects a plurality of adjacent pipes in a sequence thereof, alternate pipes of said sequence being rotatable about their own respective axes and each pipe adjacent thereto being swingable about such a respective axis.

3. In a fire-guard as defined in claim 2 wherein said hinge means comprises a series of end-overlapping links, each link being fixed at one end to a pipe and rotatably receiving an adjacent pipe at its other end.

4. In a fire-guard as defined in claim 1 wherein said pipes are of uniform diameter throughout their lengths and said hinge means cooperate with said pipes to form said air barrier.

5. In fire-guard as defined in claim 1 wherein said hinge means comprises a series of links in which each link joins adjacent pipes as a pair.

6. A fire-guard as defined in claim 1 wherein the lower portions of the pipes of said pair are circular in cross section and are adjacent one another in any relative position of the pipes and said upper portions are narrower than said lower portions so that said air flow-through region extends vertically from said selected height to the upper ends of said upper portions.

7. A fire-guard as defined in claim 6 wherein said connecting means maintains said inlet openings oriented toward said space.

8. A fire-guard as defined in claim 7 wherein said hinge means is fixed to said other pipe and rotatably receives said one pipe.

9. A fire-guard as defined in claim 8 wherein said hinge means comprises a strip portion having a first end portion rigidly connected with said other pipe and a second end portion pivotally embracing said one pipe.

10. A fire-guard as defined in claim 1 wherein said lower portions are cylindrical and said upper portions are also cylindrical and coaxial with their corresponding lower portions, said lower portions being of one diameter and said upper portions being of a second diameter which is smaller than said one diameter, said hinge means comprising a strip portion having a first end portion fixed to the upper portion of said other pipe adjacent the juncture of said upper and lower portions thereof and a second end portion pivotally embracing the upper portion of said one pipe adjacent the juncture of said upper and lower portions thereof.

11. A fire-guard as defined in claim 1 wherein said connecting means comprises hinge means pivotally connecting said pair of adjacent pipes and a third pipe adjacent said other pipe, said hinge means comprising a pair of link members, other link member having a first end portion fixed to said one pipe and a second end portion pivotally embracing said one pipe, and the second link member having a first end portion fixed to said other pipe and a second end portion pivotally embracing said third pipe.

12. A fire-guard as defined in claim 11 wherein each of said lower portions is cylindrical and of one diameter and each of said upper portions is also cylindrical and coaxial with its corresponding lower portion, said upper portions being of a second diameter which is smaller than said one diameter, each of said link member being connected to the upper portion of its associated pipe adjacent the juncture of the upper and lower portions thereof.

13. A fire-guard as defined in claim 1 wherein said rigid link includes a first ring means positioned about at least a portion of said one pipe, and a second ring means positioned about at least a portion of said other pipe, said first and second ring means having parallel end portions fixedly secured to one another.

14. A fire-guard as defined in claim 13 including spring means disposed in the space between upper portions of said pipes to prevent the passage of sparks from a fire.

* * * * *